United States Patent [19]

Schweizer et al.

[11] 3,990,724

[45] Nov. 9, 1976

[54] SKI BINDING

[75] Inventors: Gottfried Schweizer; Franz Hrachowitz, both of Vienna, Austria

[73] Assignee: Gertsch AG, Zug, Switzerland

[22] Filed: Mar. 28, 1975

[21] Appl. No.: 563,181

[30] Foreign Application Priority Data

Mar. 29, 1974 Austria ..... 2630/74

[52] U.S. Cl. ..... 280/632

[51] Int. Cl.[2] ..... A63C 9/08

[58] Field of Search ..... 280/11.35 T, 632

[56] References Cited

UNITED STATES PATENTS

| | | | |
|---|---|---|---|
| 3,733,082 | 5/1973 | Murata et al. | 280/11.35 T |
| 3,734,520 | 5/1973 | Hashioka | 280/11.35 T |
| 3,856,317 | 12/1974 | Sentou | 280/11.35 T |
| 3,873,109 | 3/1975 | Unger | 280/11.35 T |

*Primary Examiner*—Robert R. Song

*Attorney, Agent, or Firm*—Woodhams, Blanchard and Flynn

[57] ABSTRACT

A ski binding having a heel hold-down member which releases the boot whenever an overload is applied thereto. An opening lever is mounted for pivotal movement about an axis secured to a pair of parallel upstanding bearing supporting members mounted to the upper surface of a ski. One arm of the operating lever extends rearwardly of the heel hold-down member and is longer than the other arm which extends generally toward the heel hold-down member. The long arm is connected to a strap and the short arm is operatively connected to a spring-loaded operating member for controlling the movement of the heel hold-down member during the releasing operation.

15 Claims, 6 Drawing Figures

SKI BINDING

FIELD OF THE INVENTION

The invention relates to a ski binding having a heel hold-down member releasing the boot during an overload, which heel hold-down member can be released arbitrarily by an opening lever.

BACKGROUND OF THE INVENTION

Such a ski binding is described, for example, in Austrian Pat. No. 310628. In this known construction, the opening lever is manually operated by pressing down on same, for example, by means of a ski pole. In this binding, the use of a two-arm additional lever became known, which additional lever is pivotal about an axis which extends transversely to the longitudinal axis of the ski and parallel to the upper side of the ski. The known construction has the advantage that the pressing down of the actual opening lever can be carried out manually or by means of a ski pole, or by pulling up on the additional lever manually or by means of a strap. However, a disadvantage is that not only one opening lever, but also an additional lever must be used.

The purpose of the invention is to combine the opening lever and the additional lever in a ski binding of the abovementioned type and to make the manual opening or by means of a strap simple. Of course, due to the simplification of the release mechanism, opening by means of a ski pole can no longer take place.

The purpose is achieved inventively by constructing the opening lever itself with two arms and by pivotally supporting it for movement about an axis extending transversely to the longitudinal axis of the ski and parallel to the upper side of the ski, the arm of which, which does not face the heel of the ski boot, is longer than the other arm facing the heel of the ski boot, whereby the long arm is connected to a strap and the short arm is operatively connected to a spring-loaded operating member of the heel hold-down member.

The inventive construction makes it possible to open the ski binding with a smaller amount of force, because the spring-loading of the heel hold-down member engages the smaller lever arm and the opening lever is operated through the long arm.

According to a preferred embodiment of the invention, the pivot shafts for the opening lever can be adjusted during the release operation in the space between the bearing supporting members by a further shaft which is parallel with the pivot shaft, and which further shaft is arranged in the end zone of the short arm and is guided in longitudinal direction of the operating member, whereby preferably the spring engages the guide shaft.

In this manner, it is achieved, that the operating member is always loaded on the guideway of the heel holder by a spring force which corresponds to the respective opening condition.

In a different preferred embodiment of the invention, the end of the short arm engages the outer surface of the operating member, whereby the engagement point is shifted during the release operation in direction of the pivot shaft, In this manner, the force which is needed for the release remains practically constant in spite of the greater counterforce created due to the compressing of the spring.

A further characteristic of the invention is that the guide shaft is supported by means of a plate connected to the pivot shaft and is freely pivotal in a slot of the opening lever, which slot is preferably constructed slightly kidney-shaped. In this manner, it is possible to achieve during adjustment of the operating lever an as small as possible frictional resistance. In this manner additional resistances which must be overcome are avoided.

According to a different characteristic of the invention, the operating member has a longitudinal slot, which permits an adjustment of the operating member during the release operation.

According to a still further characteristic of the invention, the opening lever can also have a slot, which is constructed in the area of a holding shaft secured on the bearing supporting members and is parallel to the pivot axis. The use of this slot permits a locking of the entire system after reaching a predetermined release position, after which the spring is no longer operated, but is only pivoted by means of the operating member of the heel hold-down member. This construction, therefore, permits a positive release also in the case when the operating member would be prevented in its movement due to dirt.

A further characteristic of the invention is the provision of the end of the short arm, which end engages the outer surface of the operating member, with a rounded-off part or with a roller. Through this the frictional forces between opening lever and operating member are avoided.

BRIEF DESCRIPTION OF THE DRAWINGS

The invention will now be discussed more in detail in connection with the drawings, which illustrate two exemplary embodiments. In the drawings.

DETAILED DESCRIPTION

Figure 1:
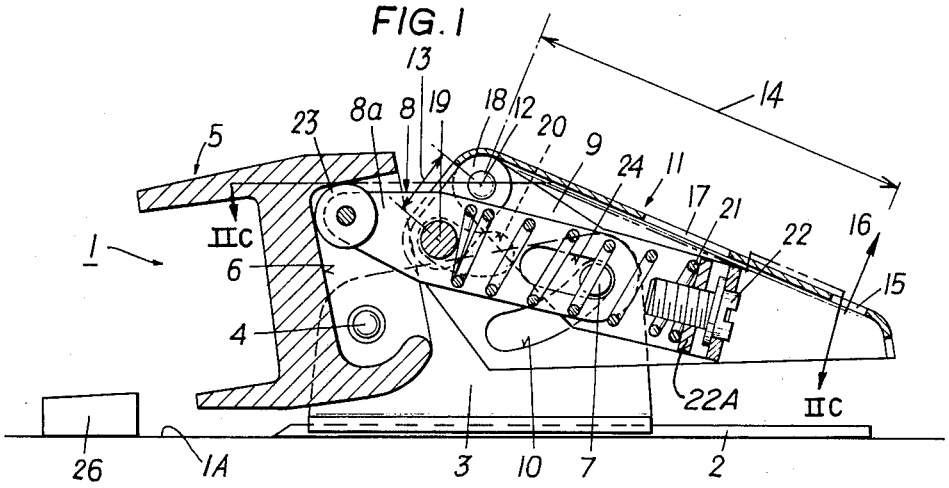
FIGS. 1, 2A and 2B illustrate a first exemplary embodiment of the invention ski binding having a closed, half-open and fully open, respectively, opening lever.

Corresponding parts have the same reference numerals, parts which fulfill similar purposes, however, are differently constructed, have index marks.

Figure 2A:
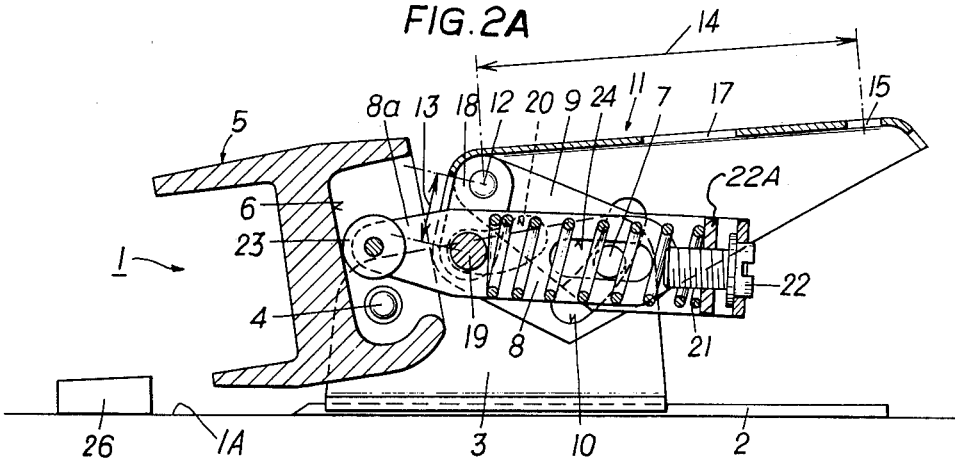
Figure 2B:
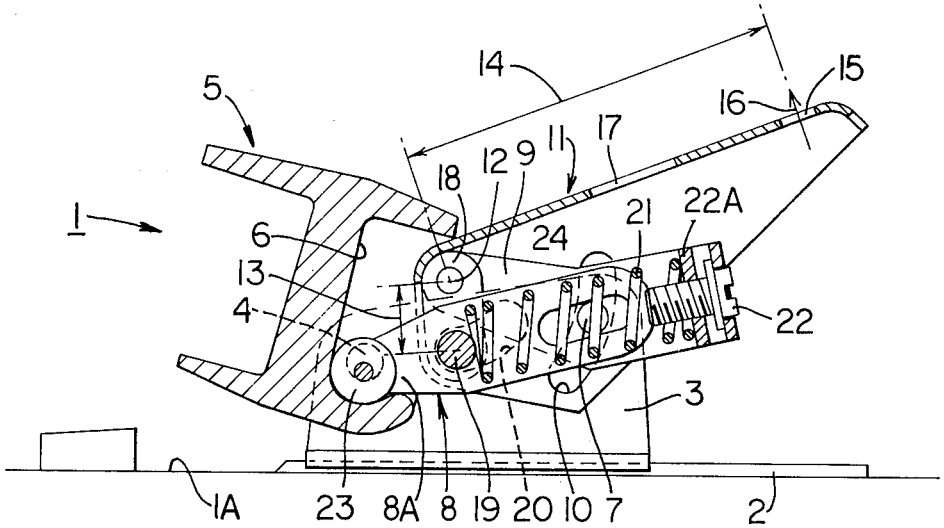
Figure 2C:
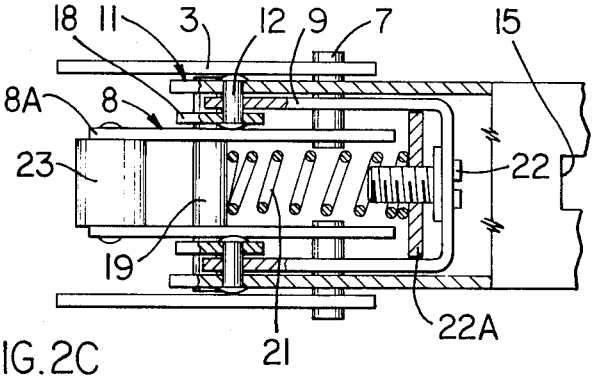
FIG. 2C is a sectional view taken along the line IIC—IIC in FIG. 1.

Accordingly to the first exemplary embodiment according to FIGS. 1, 2A and 2B the ski binding 1 has a mounting plate 2 mounted on the upper surface 1A of a ski and has a pair of upstanding bearing supporting members 3. A part which as a whole is identified as a heel hold-down member 5 is pivotally supported for movement about a pivot axis 4 on the bearing supporting members 3. The rearwardly facing surface of the heel hold-down member 5 has a guideway 6 thereon. A holding shaft 7 is mounted on each of the members 3 and is aligned transversely to the longitudinal axis of the ski. The holding shaft 7 has several functions. It is used to pivotally support an operating member 8 and a bent arm 9 and — as shown in the present exemplary embodiment — to guide the relative movements occurring between the operating member 8 and an opening lever 11, both of the operating member 8 and opening lever 11 having slots 24 and 10, respectively, therein for receiving the shaft 7 therein.

The opening lever 11 is pivotally supported on a shaft 12 and has a short arm 13 and a long arm 14. The long arm 14 extends in a direction opposite the heel hold-down member 5 and rearwardly from the shaft 12. An eyelet opening 15 or the like is provided in its free end remote from the shaft 12 and is adapted to have a strap laced therethrough, which is indicated only schematically by the arrow 16 in FIG. 1. A conventional window 17 for indicating the adjusted values can be provided in the upper surface of the opening lever 11. Since the indicating mechanism is not the subject matter of the invention, same is not discussed or shown in this disclosure. The end of the bent arm 9 facing the heel hold-down member 5 has the shaft 12 thereon. A plate 18 is mounted on the shaft 12 and has a guide shaft 19 thereon. The plate 18 determines the position of the short arm 13 of the opening lever 11. The guide shaft 19 engages the operating lever 8 and is movable with the operating lever 8. The guide shaft 19 serves as a support surface for a spring 21 and can freely move in a kidney-shaped or arcuate slot 20 in the opening lever 11. The spring 21 can be initially tensioned in a conventional manner, for example by means of an adjusting screw 22 which is longitudinally movable in or also relative to the right end of the bent arm 9. In this embodiment an abutment plate 22A is threadedly engaged with the screw 22 and the plate 22A is movable in response to a rotation of the screw 22. The free movement of the guide shaft 19 in the slot 20 permits the opening lever 11 to maintainn its initial position illustratrated in FIG. 1 during a safety release.

A slot 24, as mentioned above, is provided in the operating member 8, which slot assures a movement of the operating member 8 relative to the holding shaft 7. A roller 23 is arranged on the front end 8*a* of the operating member, which roller slides along the guideway 6 on the rearwardly facing surface of the heel hold-down member 5.

OPERATION

The inventive ski binding according to this example is operated as follows:

The opening lever 11 can be manually pulled upwardly by pulling up on the schematically illustrated strap 16. The roller 23 rolls along the guideway 6, while the opening lever 11 is swung from its initial position illustrated in FIG. 1 into the position illustrated in FIG. 2A. The spring 21 is at the same time compressed between the guide shaft 19 and the abutment plate 22A and the bent arm 9 is provided counterclockwise to cause the shaft 12 on the opening lever 11 to assume a different position in the space between the members 3. As can be recognized from FIG. 2A, the holding shaft 7 is about centered in the slot 10. If then the opening lever 11 is pivoted still further by pulling further on the strap 16, so that the holding shaft 7 engages the other end of the slot 10, the entire system will be provided as one unit about the axis of the holding shat 7 and the roller 23 rolls into the lower area of the guideway 6 of the heel hold-down member 5 and pivots the latter upwardly about the pivot axis 4 to effect an opening of the ski binding component to the position illustrated in FIG. 2B.

The above-described operation has the advantage that the operation of the opening lever 11 in the last zone of its pivotal movement does not require any additional force to overcome the force of the spring 21. Thus, only the force generated by the true weight of the heel hold-down member 5 needs to be overcome. To shift the pivot point from the pivot shaft 12 to or into the holding shaft 7 is therefore no disadvantage, because the earlier required translation does not play any important role any longer in the now existing lever arm relationships. A favorable relationship between the lengths of two arms 13,14 of the opening lever 11 lies approximately at 1:3 to 4. In FIGS. 1 and 2A, the length relationships is 1:5 to 6. The relationship of the two arms, which must now be thought in relationship to the holding shaft 7, lies approximately at 1:1.

A conventional stepping plate is identified by reference numeral 26, which stepping plate is used to support the sole of a not illustrated ski boot thereon.

ALTERNATE CONSTRUCTION

Figure 3:
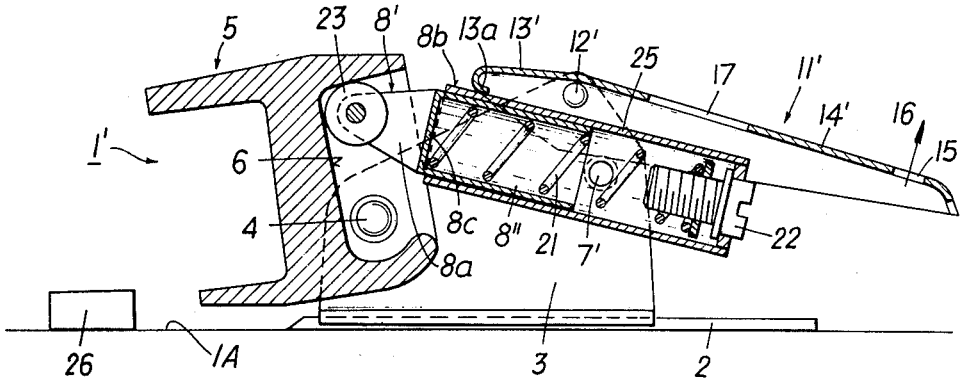
FIGS. 3 and 4 are each schematic side views, partly cut, of a second exemplary embodiment of the invention also having a closed and half-open opening lever.
Figure 4:
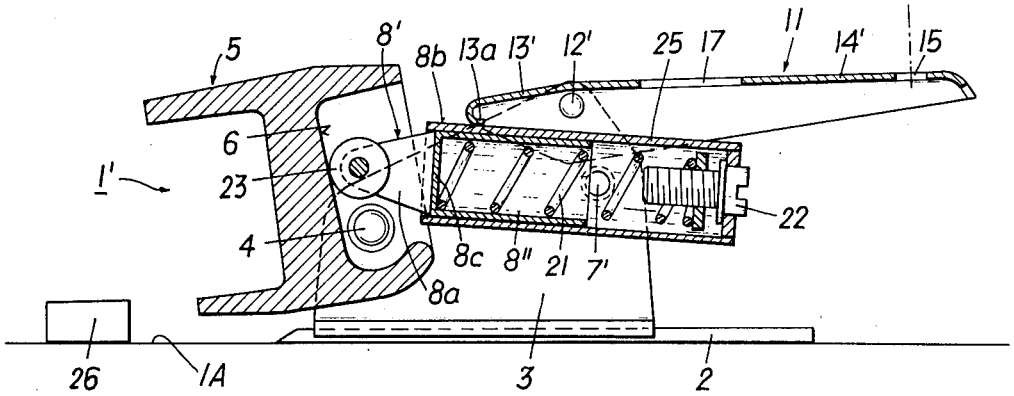

In an exemplary embodiment according to FIGS. 3 and 4, a fixedly arranged pivot shaft 12′ is provided on the bearing supporting members 3. The short arm 13′ of the opening lever 11′ has a rounded-off portion 13a. In place of this rounded-off portion it would also be possible to substitute a roller or the like. The rounded-off portion 13*a* slides on the outer surface 8*b* of the operating member 8′ which, like in the exemplary embodiment according to FIGS. 1 and 2A, is biased to the left by a spring 21. However, a wall 8*c* provided on the operating member 8′ forms here the front support surface against which is engaged the spring 21. The operating member 8′ is in the present case pivotal about the axis of the holding shaft 7′, which in this case forms the only pivot axis for the operating member 8′.

The operation of the embodiment of FIGS. 3 and 4 is similar to the earlier described exemplary embodiment, only that here the opening lever 11′ slides with its short arm 13′ or its rounded-off front part 13*a* on the outer surface 8*b* of the operating member 8′. The relationship of the two arms 13′,14′ remains constant during the entire release operation according to this exemplary embodiment, namely the force of the spring 21 must constantly be overcome during the opening sequence. The outer surface 8*b* of the entire operating member 8′ is formed according to this exemplary embodiment and is defined by the outer surface of a tube 25 in which the actual operating member 8′′ is supported for longitudinal movement against the force of the spring 21. Further types of construction and operations correspond substantially to the embodiment described in FIGS. 1, 2A, 2B and 2C.

The invention is not to be limited to the above exemplary embodiments. For example, it is also possible to provide at the front part of the operating member, instead of the roller, a rounded-off guide surface as shown in our copending application Ser. No. 554,438, filed Mar. 3, 1975. It is also possible according to the first exemplary embodiment, to leave out the plate connecting the shaft 12 and the guide shaft 19 and to construct the short lever arm 13 simultaneously for receiving the two shafts. As already mentioned, the slot 10 is not needed, when only the opening lever is guided on a different part and the holding shaft 7, leaving out the area of movement of the opening lever 11, is used for two purposes.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privelege is claimed are defined as follows:

1. A ski binding, comprising:

a base member;

a holding part for engaging a boot sole, said holding part having elongated guideway means thereon having first and second spaced limits;

first pivot means for pivotally securing said holding part to the base member, said holding part being pivotal between a position of use and a step-in position;

lever means having first and second arms;

second pivot means located rearwardly from said first pivot means for pivotally securing said lever means to said base member, said first arm being longer than said second arm;

operator means reciprocally and pivotally mounted on said base member and engaging said guideway means and being movable over the length thereof between said first and second limits about said second pivot means;

connecting means operatively connecting said second arm to said operator means whereby when a force is applied to said first arm to pivot said first and second arms about said second pivot means, said connecting means urges said operator means between said first and second limits; and resilient means for resiliently holding said operator means in engagement with said guideway means and at at least one of said limits corresponding to one of said position of use and said step-in position.

2. A ski binding according to claim 1, wherein said second pivot means includes first and second spaced pivot axes and second lever means, said second lever means being pivotally secured to said base member about said first pivot axis and carrying said second pivot axis therewith, said first-mentioned lever means being pivotaly secured to said second lever means for movement about said second pivot axis.

3. A ski binding according to claim 2, wherein said connecting means includes elongated plate means pivotally connected at one end to said second lever means about said second pivot axis and at the other end to said operator means about a third pivot axis, the spacing between said second and third pivot axes defining said second arm.

4. A ski binding according to claim 3, wherein said first lever means includes an elongated and arcuate slotted opening therein receiving a bolt which defines said third pivot axis.

5. A ski binding according to claim 4, wherein said first lever means has a second elongated and arcuate slot therein receiving said first pivot axis therethrough.

6. A ski binding according to claim 2, wherein said operator means includes an elongated operating member having contoured means at one end thereof engaging said guideway means and an elongated slot therein receiving said first pivot axis therethrough.

7. A ski binding according to claim 6, wherein said second pivot means includes first and second spaced pivot axes and second lever means, said second lever means being pivotally secured to said base member about said first pivot axis and carrying said second pivot axis therewith, said first-mentioned lever means being pivotally secured to said second lever means for movement about said second pivot axis.

8. A ski binding according to claim 2, wherein said first and second limits are located on opposite sides of a theoretical straight line connecting said first pivot axis and said first pivot means, said operator means, when aligned with said straight line, being in a dead-center position whereby said resilient means urges said operator means to either one of said first and second limits on opposite sides of said straight line depending on the direction of force applied to said holding part by said ski boot.

9. A ski binding according to claim 1, wherein a strap is secured to said first arm.

10. A ski binding according to claim 1, wherein said first and second arms are located on opposite sides of said second pivot means.

11. A ski binding according to claim 1, wherein said second pivot means includes fixed first and second pivot axes on said base member; and wherein said lever means is pivotally supported for movement about said first pivot axis; and wherein said operating means is pivotal about said second pivot axis.

12. A ski binding according to claim 11, wherein said operating means includes guide means pivotal about said second pivot axis and an operating member slidably disposed on said guide means and having contoured means at one end thereof engaging said guideway means.

13. A ski binding according to claim 11, wherein said connecting means includes a contoured end on said second arm of said lever means engaging said operator means.

14. In a ski binding having a base member, a heel holder which releases a ski boot upon an overload, said heel holder being releasable arbitrarily by a two-arm opening lever having a long arm and a short arm, said opening lever cooperating with said short arm with a spring-loaded operating member for controlling the release of said heel holder, first pivot means for pivotally supporting said operating member on said base member and further includes a strap connected to said long arm, the improvement comprising wherein the end of said short arm of said opening lever engages said operating member, second pivot means for pivotally supporting said opening lever on said base member at the juncture between said long and short arms, the engagement point of said opening lever on said operating member being shifted during the arbitrary release operation in direction of said first pivot means.

15. The improved ski binding according to claim 14, wherein the end of said short arm which engages said operating member has an arcuate section.

* * * * *